US006494145B2

(12) United States Patent
Kernan

(10) Patent No.: US 6,494,145 B2
(45) Date of Patent: Dec. 17, 2002

(54) AUTOMATIC CROSSBAR ON SKI CHAIR-LIFT FOR FACILITATING PASSENGER DISMOUNT

(76) Inventor: Joseph F. Kernan, P.O. Box 680182, Park City, UT (US) 84068-0182

( * ) Notice: Subject to any disclaimer, the term of this patent is extended or adjusted under 35 U.S.C. 154(b) by 0 days.

(21) Appl. No.: 09/954,659

(22) Filed: Sep. 14, 2001

(65) Prior Publication Data

US 2002/0046674 A1 Apr. 25, 2002

Related U.S. Application Data

(60) Provisional application No. 60/232,794, filed on Sep. 15, 2000.

(51) Int. Cl.[7] ..... B61B 12/00

(52) U.S. Cl. ..... 105/149.1; 104/28; 297/487

(58) Field of Search ..... 105/148, 149.1, 105/149.2; 297/464, 468, 469, 474, 487, 488; 280/748, 756; 104/179.2, 178, 28

(56) References Cited

U.S. PATENT DOCUMENTS

| | | | | | |
|---|---|---|---|---|---|
| 3,556,014 | A | | 1/1971 | Rudkin | 104/173.2 |
| 3,556,015 | A | * | 1/1971 | Pender | 104/173.2 |
| 4,303,016 | A | | 12/1981 | Tauzin | 104/173.2 |
| 4,700,632 | A | * | 10/1987 | Schmutz | 104/53 |
| 4,784,065 | A | | 11/1988 | Brochand | 104/173.2 |
| 5,213,048 | A | | 5/1993 | Kunczynski | 105/149.2 |
| 5,499,844 | A | | 3/1996 | Dirck | 280/748 |
| 5,529,382 | A | * | 6/1996 | Burkat | 280/748 |
| 5,586,503 | A | * | 12/1996 | Rehorn | 104/241 |
| 5,853,193 | A | | 12/1998 | Marshall | 280/748 |
| 6,299,207 | B1 | * | 10/2001 | Bares | 180/268 |

* cited by examiner

*Primary Examiner*—Mark T. Le

(57) ABSTRACT

An automatic crossbar on a ski chair-lift for containing seated passengers and facilitating dismounting passengers. A vertically elongated bar (20) with a cross (20*a*) attached at its base is pivotably suspended from a passenger chair, positioning the crossbar in front of passengers. An elastic closure attachment (9), and/or an automatic locking mechanism (60), is attached between the elongated bar and the chair to retain the crossbar in a closed position and contain passengers. A blocking structure (200) is suspended proximal to the aerial cable above the landing platform. The elongated bar has an upper portion (20*v*) above its pivotal mount (21*b*) which impacts the blocking structure as the aerial cable moves the chair forward. The impact causes the upper portion to rotate back as the lower portion and crossbar are levered forward and upward. As the crossbar swings forward from the chair, passengers grasp the crossbar to balance with while standing onto the landing platform.

20 Claims, 9 Drawing Sheets

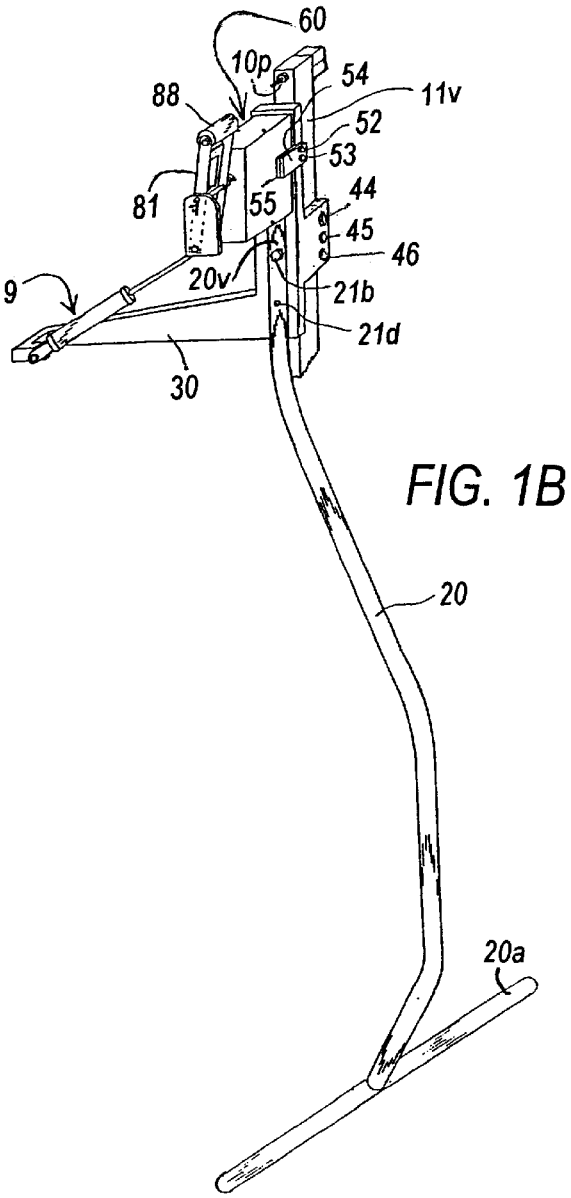
FIG. 1B
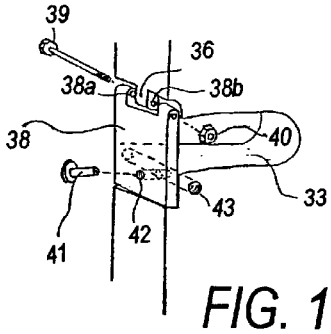
FIG. 1CA
FIG. 1C
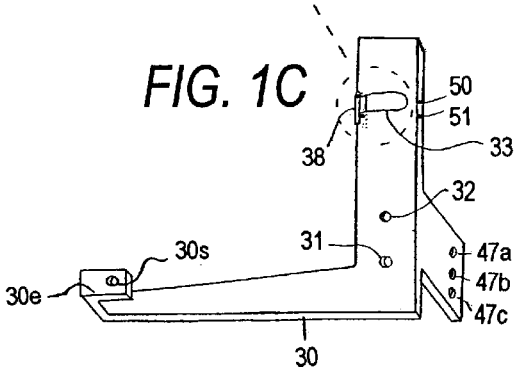
FIG. 1D
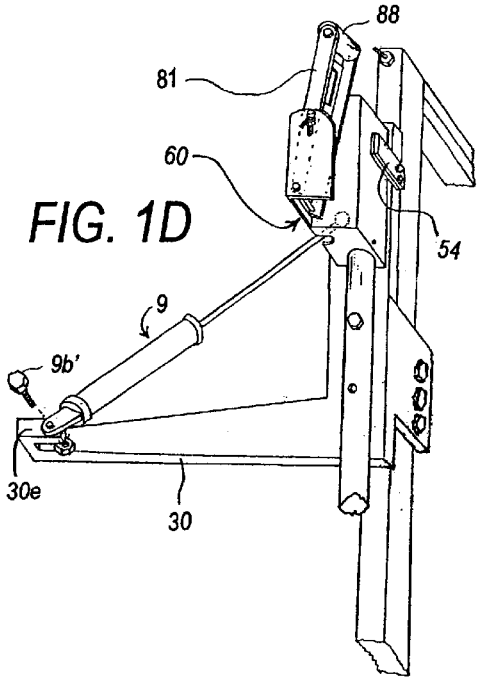
FIG. 1E
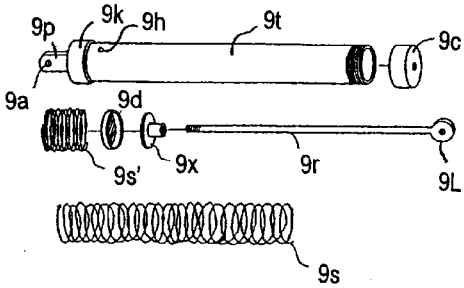

AUTOMATIC CROSSBAR ON SKI CHAIR-LIFT FOR FACILITATING PASSENGER DISMOUNT

CROSS REFERENCE TO RELATED APPLICATIONS

This application claims the benefit of Provisional application No. 60/232,794, filed Sep. 15, 2000.

FEDERALLY SPONSORED RESEARCH

Not Applicable

SEQUENCE LISTING OR PROGRAM

Not Applicable

BACKGROUND—FIELD OF INVENTION

The invention relates to a ski chair-lift having chairs coupled on the line to an aerial cable and equipped with enclosures that contain passengers.

BACKGROUND—DESCRIPTION OF PRIOR ART

Skiers and other passengers riding on present chair-lifts assume several risks. These risks include falling off chairs during transport, getting frost bitten, and falling when dismounting. Beginners regularly fall on the slick snow packed landing ramp. They are often injured or embarrassed. Some are unable to safely dismount after many attempts. People that fall on the exit ramp cause problems for others as well. Falling beginners may pull co-passengers down with them. Other skiers may crash into fallen people on the exit ramp. Lift operators that intervene to "make a save" may be injured by lifting people, having a slip-and-fall accidents, or by being run into by others. When some falls, the operator may have to stop the lift. Stopped lifts causes time delays for people in route, and for those waiting in the lift-line.

Prior art automatic enclosures on chairs

The relevant prior art concerns devices that assist passengers with riding on ski chair-lifts. Several prior art devices (U.S. Pat. Nos. 3,556,014 by Rudkin (1969); 4,303,016 by Tauzin (1981); and 4,784,065 by Brochand (1988)) have automatic swing-back enclosures, capable of occupying a lowered position protecting the passengers sitting on the chair, and an open position for passengers to mount and dismount from the chair. These automatic enclosures swing up and back over the heads of passengers. These chairs provide no mechanism to assist less experienced passengers with dismounting onto the slippery snow surface. They are designed to be used by accomplished chair-lift riders. Thus, beginner skiers regularly fall.

Manually operated safety-bar enclosures

Most chair lifts provide manually operated enclosures, sometimes called "safety-bars". The enclosures are cage-like with a crossbar in front. These safety-bars swing up and back with similar pivotal mechanics as shown in the prior art above. Users rotate the crossbars up and back over their heads prior to unloading. Like prior art above, the safety-bar enclosures are attached by pivotal mounts on the rear or sides of the chair. To contain skiers after loading, passengers pull the crossbar down from above and behind their heads. However, as one passenger lowers the bar, the crossbar may accidentally hit another passenger in the head (if that passenger is leaning forward) as it comes down from above and behind. It is necessary for all passengers to lean forward in order to balance while sitting down. Many safety-bars are "U" shaped. They run across the front of passengers and bend 90° at each side to run directly above and parallel with the arm rests. The sides of these "U" shaped safety-bars rest on both of the chair's arm-rests when the safety-bar is closed. Accordingly, if one's arm is on the arm rest when the safety-bar is closed, a skiers' arm may be caught between the safety-bar and the arm-rest. To prevent these accidents when closing the safety-bar, passengers must learn to sit up straight with their arms at their sides after mounting the chair. If used correctly, safety-bars help passengers to be transported safely. Yet, many novices fail to pull the crossbar down during transport, or to raise the crossbar in time for unloading. The lift must be stopped if the crossbar is not raised for dismounting. Accordingly, to avoid delays, many ski resorts have no safety-bars on their beginner lifts. Because the existence of safety-bars does not guarantee a safe transport, some resorts choose not to call them safety-bars. Additionally, prior art enclosures on ski chair-lifts do not provide a mechanism to help passengers dismount without falling. Many chair lift related injuries occur when people fall from chairs during transport or fall on the landing platform during dismount.

SUMMARY

An automatic locking and unlocking crossbar on a ski chair-lift for containing seated passengers, and for facilitating dismounting passengers. To contain passengers, a vertically elongated bar, suspends a horizontal crossbar in a locked position in front of seated passengers. The vertically elongated bar is pivotably mounted near its top to an aerial chair's suspension bar. At the exit terminal, the crossbar is levered forward and upward away from the front of the chair. To facilitate dismounting, passengers may grasp the crossbar to assist them with standing. The crossbar is levered forward and upward by the impact of a blocking structure against the top of the elongated bar (above its pivotal mount).

Objects and Advantages

Accordingly, the objects and advantages of this automatic crossbar are as follows:

(a) to provide an open crossbar to allow passengers to mount;
(b) to permit mounting and dismounting at top, bottom, and mid-station platforms;
(c) to gradually close the crossbar after the chair is mounted;
(d) to provide an automatic crossbar that locks closed;
(e) to allow it to be unlocked by someone from the ground during an emergency;
(f) to provide a fail-safe brake-away system to force the lock open if it fails, so as to not damage the lock or endanger passengers;
(g) to protect passengers from falling, or jumping, out of a lift prematurely;
(h) to prevent users from falling or crashing into each other when dismounting;
(i) to provide safety for passengers that forget, or are unable, to close a crossbar;
(j) to provide passengers with increased sense of being contained and safe;
(k) to function in various weather conditions, including during snow and ice storms;
(l) to protect the components from excessive wear;
(m) to provide passenger with balancing assistance for standing when dismounting;
(n) to reduce time delays and injuries related to the falling of dismounting passengers;
(o) to allow the crossbar to shut and contain passengers without hitting the top of a passengers head or catching a passenger's arm between the safety-bar and the arm rest;

(p) to provide snowboarders with increased balance to set in their rear boot while dismounting.

Further objects and advantages will become apparent from consideration of the ensuing description and drawings.

BRIEF DESCRIPTION OF DRAWING FIGURES

DETAILED DESCRIPTION OF INVENTION

Figure 1A:
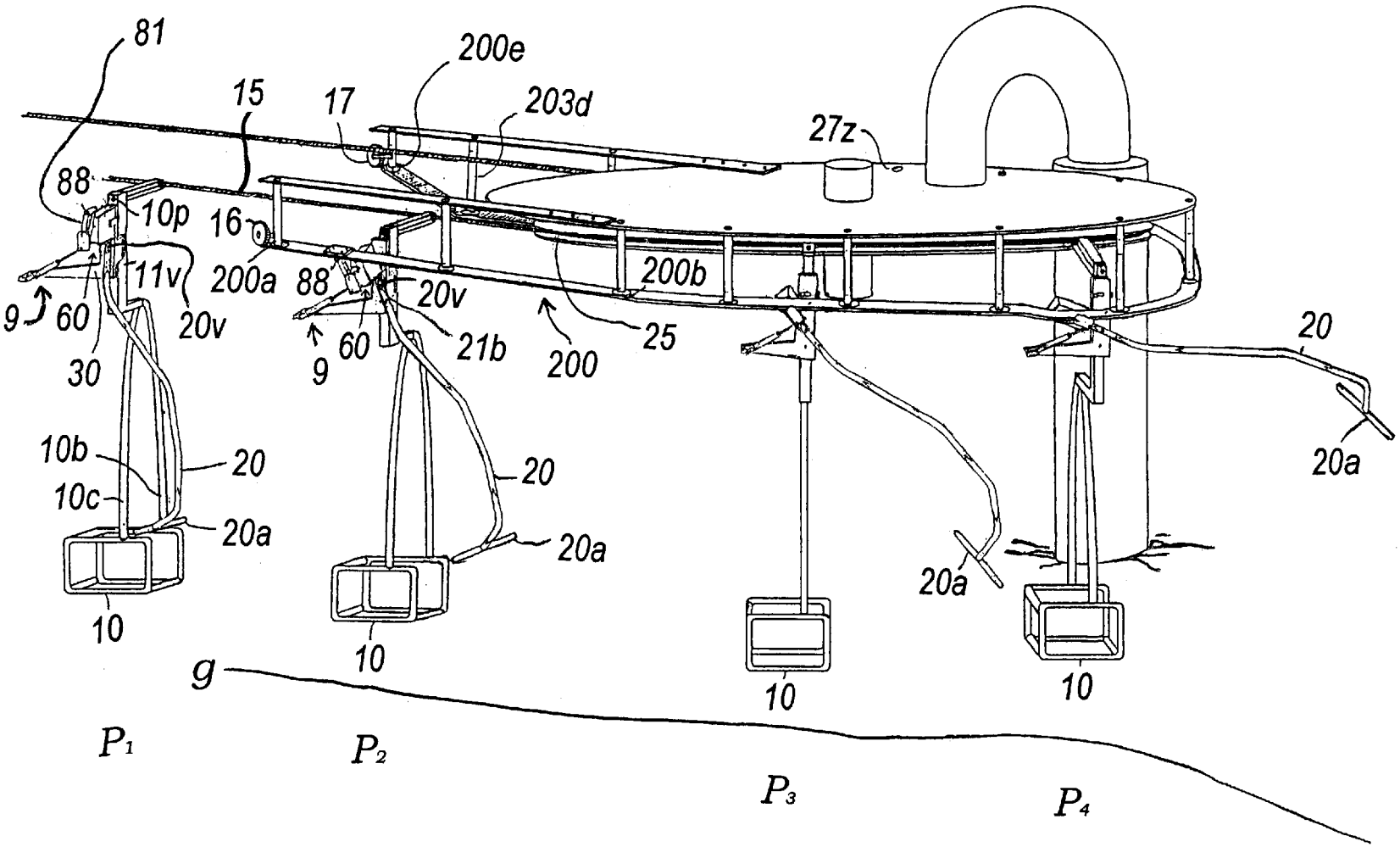
FIGS. 1A to 1N shows the preferred locking and facilitating crossbar and its components.
Figure 1F:
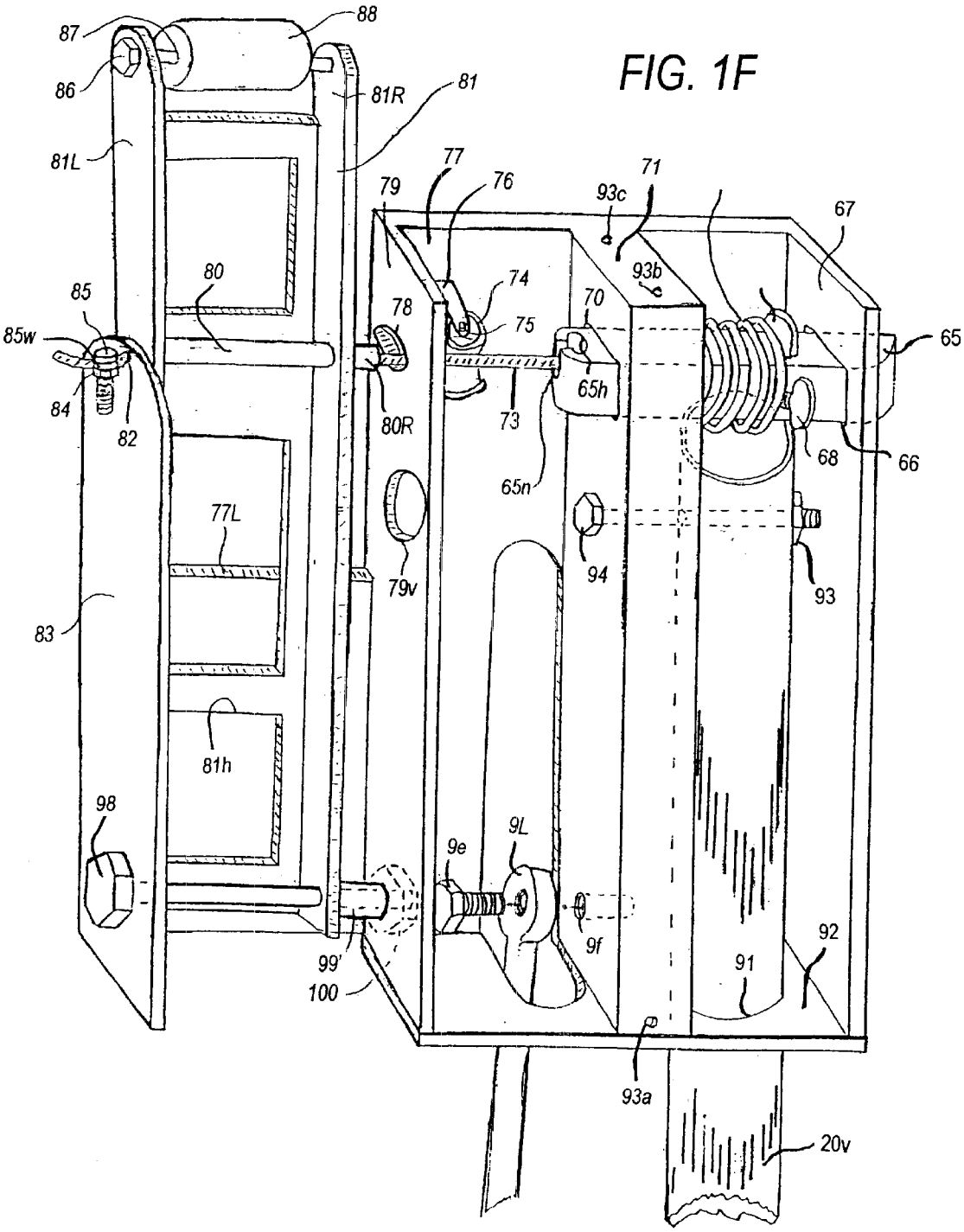
Figure 1H:
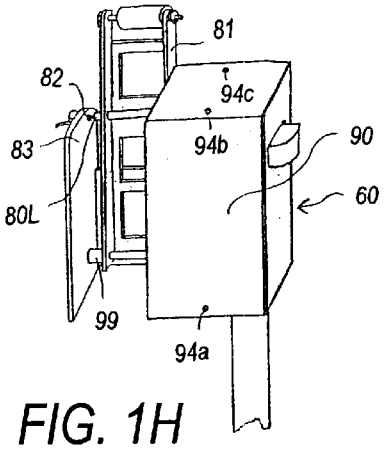
Figure 1I:
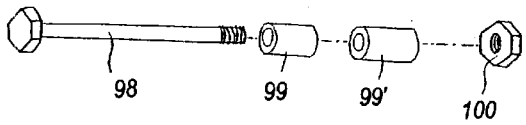
Figure 1G:
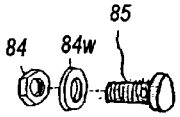
Figure 1J:
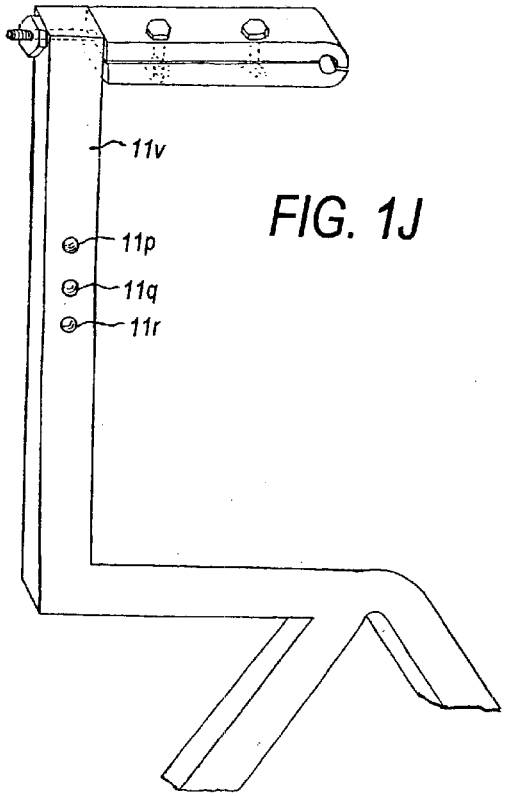
Figure 1K:
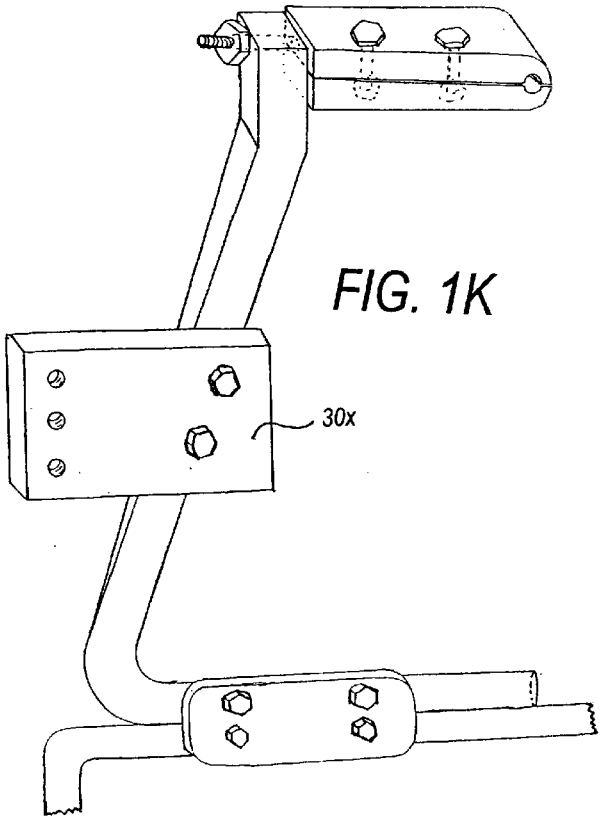
Figures 1L, 1M, 1N:
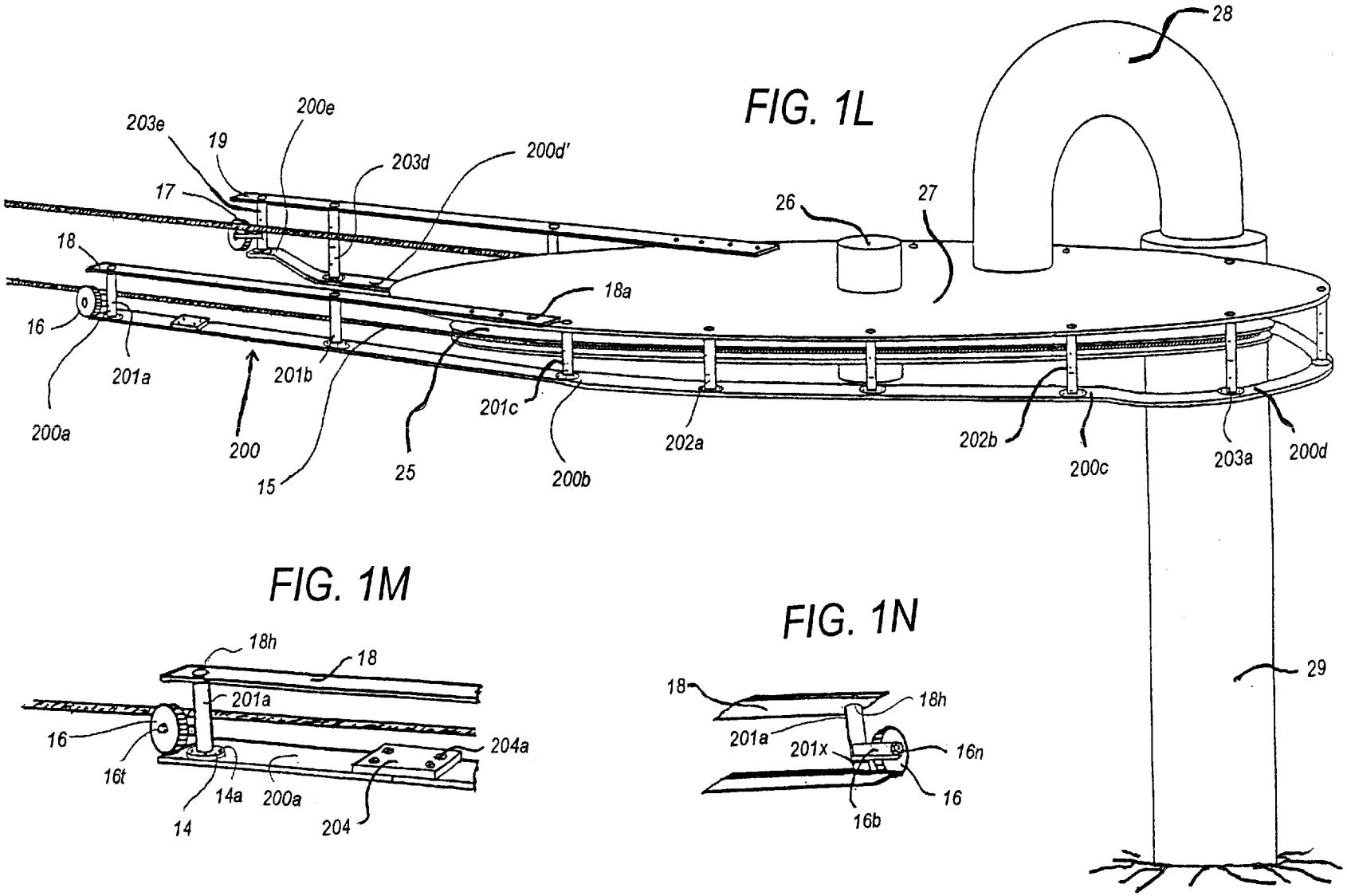

Description of FIGS. 1A to 1N:

The preferred embodiment is a method for facilitating passengers with their dismount onto a landing platform from chairs on aerial ski chair-lifts. This method provides a crossbar for gripping in front of passengers in its first closed position during transport. This method moves the crossbar forward away from the front of the chair to a second opened position during dismount. To contain passengers, this method also provides for retaining and for locking the crossbar in its first closed position across the front of the chair during transport. It further provides a method for unlocking the crossbar prior to the passenger's dismount. This method of providing an automatic crossbar on a ski chair-lift permits passengers to grasp the crossbar as it moves forward, facilitating their standing onto the slippery platform.

The invention shown in FIG. 1A relates to a chair-lift at a ski resort having chairs coupled in line to an aerial cable. The locking and facilitating crossbar is the presently preferred embodiment of the automatic crossbar. Both terminals, at the top and at the bottom of the hill, are equipped with the suspended rail system shown in FIG. 1A. FIG. 1A shows four positions ($P_1$, $P_2$, $P_3$, $P_4$) for chair 10 and crossbar 20*a* as they move towards and around the chair-lift terminal. The automatic crossbar device is in its first closed position ($P_1$) with crossbar 20*a* suspended across the front of the passenger chair, approximately thirty inches off of the ground (g). The crossbar length measures several inches shorter than the width of arched bars 10*b* and 10*c*.

Crossbar 20*a* is in its second opened position to the front of the passenger chair in $P_2$, $P_3$, and $P_4$. In position $P_2$, crossbar 20*a* is opened several inches in front of the chair (approximately thirty two inches off the ground). In position $P_3$, the chair's crossbar is opened approximately forty two inches off the ground (g). In its final opened position ($P_4$), crossbar 20*a* is opened approximately eight feet above a down ramp. As the chair moves past position $P_4$, the crossbar remains high until it departs the terminal past wheel 17. It is recommended that the landing platform be graded flat or slightly uphill from under position $P_1$ until position $P_3$. The exit platform should be graded to slope downward at position $P_4$.

FIG. 1B shows the bars composed as follows: Elongated bar 20 begins in lock-box 60 (described later), and then runs past a pivotal mount at bolt 21*b*. The pivotal mount with bolt 21*b* includes a washer (not shown) between the elongated bar and plate 30. The washer is made from an automobile brake pad. First, a hole is drilled in the brake pad, and then a washer is cut out of the material surrounding the hole (with the use of a cup-like and serrated drill attachment). Bolt 21*b* is the mechanism for pivotably mounting the elongated bar to the passenger chair. The pivotal mount on the elongated bar is substantially above the crossbar. The elongated bar has an upper mounting hole (not shown) under bolt 21*b,* and a lower mounting hole (21*d*). The elongated bar continues as it angles forward, down, and back (from a sitting passengers perspective) to be welded horizontally to crossbar 20*a* on bottom. Elongated bar 20 in FIG. 1B is substantially vertical in its first closed position. For safety, the crossbar and the elongated bar are covered with a half inch layer of spongy rubber.

FIG. 1B shows arm-like plate 30 attached to suspension bar 11*v* with locking nuts (not shown), and bolts 44, 45 and 46. The bolts are run through holes 47*a,* 47*b,* and 47*c* in plate 30 (FIG. 1C), and holes 11*p,* 11*q,* and 11*r* in suspension bar 11*v* (FIG. 1J). FIG. 1A also shows the plate's attachment at the top of suspension bar 11*v* on the chair in position $P_1$. Arm-like plate 30 in FIGS. 1A and 1B is attached to position roller 88 in line with the axis of pivotal attachment 10*p* of the chair's cable clamp. Roller 88 is a sub-member of the upper portion of the elongated bar.

Elongated bar 20 in FIG. 1B is pivotably mounted to plate 30 with bolt 21*b,* which runs through the elongated bar and then into plate 30 (using threaded upper hole 32 in FIG. 1C). Alternatively, bolt 21*b* in FIG. 1B may be run through lower hole 21*d* in elongated bar 20 and then through threaded a lower hole (hole 31 on plate 30 in FIG. 1C). (The operation section describe the use of hole 31.) In FIG. 1B, stop-plate 54 is shown attached to plate 30 with bolts 52 and 53, through threaded holes (see holes 50 and 51 in FIG. 1C).

Rail system 200 in FIG. 1A is a blocking structure. Rail system 200 is disposed above the landing platform in the path of the upper portion of the elongated bar as the passenger chair moves forward. The rail system and components are enlarged in FIGS. 1L, 1M, and 1N. In FIG. 1L, horse-shoe shaped rail system 200 is shown suspended from position 200*a* to position 200*e*. Rail system 200 is a stationary horse-shoe shaped rail system suspended to the outside of bull-wheel 25. Circular plate 27, arched tower section 28 and vertical tower 29 remain stationary as bull-wheel 25 and wheel core 26 rotate.

The rail is attached with various planks bolts and pipes. FIGS. 1M (front view) and 1N (back view) show that threaded pipe 201*a* is screwed upward into threaded hole 18*h* in plank 18. Then threaded disc 14 is screwed onto the bottom of pipe 201*a*. Threaded disc 14 is attached to rail 200*a* with screws into threaded holes, including screw 14*a*. The other pipes that suspend the rail from the circular plate are attached in the same manner. Plank 18 in FIG. 1L is bolted to circular plate 27 with bolts into threaded holes, including bolt 18*a*. Plank 19 is attached similarly. Rail system 200 in FIG. 1L may be constructed of smaller rail sections to form one rail by using small connection plates (see connection plate 204 and screw 204*a* in FIG. 1M).

As shown in FIG. 1L, pipes 201*a,* 201*b,* and 201*c* are of equal length. The rail is level from position 200*a* to position

200*b,* as it runs parallel to cable 15. The pipes get progressively longer from 202*a* to 202*b,* and the rail slopes downward slightly. From position 200*b* to 200*c* the rail slopes downward gradually as it rounds to the left with the outer edge of circular plate 27. Pipe 203*a* is substantially longer than pipe 202*b*. The rail slopes downward quickly from position 200*c* to 200*d*.

The length of pipe 203*a* to pipe 203*d* (at the far end of the horse-shoe rail) are equal in length with the rail at its lowest position. The rail is level as it rounds from position 200*d* to position 200*d'* in its lowest position. Shorter pipe 203*e* is attached beyond the inclined section of the rail beside blocking wheel 17. Wheel 17 is suspended at the same height as blocking wheel 16. As shown in FIGS. 1M and 1N, wheel 16 is attached with bolt 16*t* and a nut 16*n* to attachment bar 16*b*. Bar 16*b* is welded to pipe 201*a* along its contact area, including at position 201*x*. Wheel 17 in FIG. 1L is attached in the same manner as wheel 16 is attached.

The lock-box is a closure attachment mechanism for retaining the crossbar in its first closed position by attaching the elongated bar to the passenger chair. The lock-box includes a lock releasing assembly mechanism for releasing the lock when it impacts the rail-like blocking structure. FIG. 1F shows the components making up the lateral-extension and lock-box unit at the top of the elongated bar. To assemble it, bolting probe 65 is backed in through hole 66 in box wall 67, through spring 72, and then through hole 70 in wall 71. Thumb screws 68 and 69 are screwed into threaded holes in bolting probe 65. The back of bolting probe 65 has bole 65*h* and notch 65*n* for inserting and securing a plug (not shown) that is fused to the end of wire 73. The plug fits tightly in hole 65*h*. Bracket 76 (a squared off "U" shaped bracket) is attached to the top and bottom of spool 74 by pin 75 and then is welded to wall 77. Wire 73 runs across spool 74. Wire 73 continues past the spool and through arched slot 78 in wall 79, before running through the right side (80R) of casing 80 (which runs through the side walls 81R and 81L of hinged lever 81). Lever 81 is a lock releasing lever. Wire 73 continues out of casing 80L (see FIG. 1H) through hole 82 in wall 83. Wire 73 is then cinched at the top of cinching bolt 85, with washer 85*w* and nut 84. (Also see cinching bolt 85, washer 85*w* and nut 84 in FIG. 1G.)

Roller 88 in FIG. 1F is a steel roller with a wear resistant rubber coating. To attach roller 88, bolt 86 runs through side-wall 81L of hinged lever 81, through hole 87 in roller 88, through side-wall 81R, and is then secured with a locking nut (not shown). Back wall 77L is about half the height of wall 77. Wall 77L connects wall 83 and wall 79. Wall 77 is fused across the back of walls 67, 71, and 79. The walls are welded together, or molded as one piece (as shown). Floor 92 of the lock-box is welded across the bottom of walls 67, 71, and 79. Hole 91 in floor 92 receives the top of vertical section 20*v* of the elongated bar, before it is attached to wall 71 by bolt 94, and nut 93. Void 79*v* provides a hole to place bolt 94 through during assembly. Cover plate 90 in FIG. 1H is attached to enclose the lock-box. In FIG. 1H, cover plate 90 is attached with screws 94*a,* 94*b,* and 94*c*. FIG. 1F, shows holes 93*a,* 93*b,* and 93*c* for attaching cover plate 90 to wall 71. The bottom of hinged lever 81 in FIG. 1F has large square voids, including void 81*h*. Casing 80 is secured through the side-walls of lever 81 by a tight fit. Bolt 98 runs through holes in the bottom of walls 83 and 79 and into locking nut 100. Lever 81 is centered with tubes (including tube 99') on each side of it. FIG. 1I shows bolt 98, nut 100, and tubes 99' and 99.

FIG. 1C shows slot hole 33, and break-away flap 38. In FIG. 1CA, brake-away flap 38 is shown to hang across the side of slot 33. Brake-away flap 38 hangs by bolt 39, which is run through holes 38*a* and 38*b,* and through protrusion 36, before being secured by locking nut 40. Break-away flap 38 is affixed at its bottom by rivet 41 through hole 42.

Plate 30 in FIG. 1C includes an offset protrusion (30*e*) with threaded hole 30*s* to attach the compression shock. The compression shock is a closure attachment mechanism. The shock also falls within the categories of an elastic attachment mechanism, an elastic expansion device, and a spring attachment mechanism. FIG. 1D shows bolt 9*b'* attaching shock 9 to protrusion 30*e* on plate 30. The attachment other side of the shock is shown in FIG. 1F. The shock's rod loop (9L) is attached by bolt 9*e* into threaded hole 9*f*.

Compression shock 9 is shown completed in FIG. 1D. In FIG. 1E, the components of the compression shock is shown. Threaded cap 9*k* is screwed air-tight to the left side of threaded tube 9*t*. Spring 9*s* is placed within tube 9*t*. Steel rod 9*r* is run through the hole in the top of threaded cap 9*c* (without cap 9*c* screwed on). There is some air space between rod 9*r* and the hole in cap 9*c*. The threaded end of rod 9*r* is screwed into a threaded hole in pacifier-like disc 9*x*. Disc 9*x* is rigid. Rubber diaphragm 9*d* is stretched onto disc 9*x*. Rod 9*r* along with attached disc 9*x* and diaphragm 9*d* is inserted into tube 9*t*. Diaphragm 9*d* provides an almost air tight seal in the top of tube 9*t*. Spring 9*s* is compressed slightly as cap 9*c* is screwed on. The spring is shown fully compressed as spring 9*s'*. The shock is a spring attachment mechanism. The almost air-tight diaphragm creates a left and right side of the chamber between the capped ends of tube 9*t*. Small air hole 9*h* is shown on the left side of the chamber. Loop 9L is on the end of steel rod 9*r*. Cap 9*k* includes a protrusion (9*p*) that is welded to the cap. Hole 9*a* runs through protrusion 9*p*.

Shock 9 is shown attached in FIG. 1D. Spring 9*s* (FIG. 1E) resists forces that compress the shock. Small hole 9*h* in the left chamber allows air to pass through when the shock is compressed or lengthened. The spring will return the shock to a lengthened position when a force is removed. The minimal tolerance between the circumference of rod 9*r* and the hole in cap 9*c* permits some air to pass through. The speed at which the spring opens the shock to its original position is slowed by air compression in the nearly air-tight right chamber between the diaphragm and cap 9*c*. The air chambers on each side of the diaphragm also minimize bouncing. The compression shock retains the crossbar in a closed position during transport, by attaching the elongated bar to the passenger chair. Additionally, because the washer on bolt 21*b* is made of brake pad materials, it creates friction between the elongated bar and plate 30, thereby not allowing the elongated bar to pivot too quickly (even is the shock were to fail). The tightness of bolt 21*b* may be adjusted to control the amount of friction from the brake-pad washer.

The lock-box is an automatic locking mechanism. Lever 81 in FIG. 1F functions as a lock releasing lever. The lock-box is unlocked in FIG. 1A when moving aerial cable 15 brings the lateral extension and lock-box 60 (including roller 88) into contact with wheel 16. Wheel 16 moves lever 81 by impacting roller 88. Roller 88 acts as a sub-member of the upper portion of the elongated bar. The in line positioning of roller 88 and pivotal attachment 10*p* permits the chair to swing for and aft without altering the height of roller 88 as it approaches wheel 16. Roller 88 is a mechanism that reduces friction and wear on the upper portion of the elongated bar, when it impacts the blocking structure. Spring 72 forces bolting probe 65 to protrude through hole 66, unless it is impacted from the front, or pulled by wire 73. FIGS. 1D and 1F shows that roller 88 may move lever 81 back against back wall 77L. Wire 73 (FIG. 1F) is secured to bolting probe 65. Thus, pushing lever 81 with roller 88 unlocks the lock-box by moving wire 73, and pulling bolting probe 65 from the slot. Thus, bolting probe 65 backs out completely from its insertion through hole 66 into slot (see slot 33 in FIG. 1C). Rivet 41 in FIG. 1CA protrudes and spreads out into cavity 43 to hold the break-away flap shut. If the lock-box fails to release, then rivet 41 will break and allow break-away wall 38 to open. Void 81*h* in FIG. 1F prevents falling snow from building up between wall 77L and lever 81.

Roller 88 and lever 81 (FIG. 1D) are arranged to remain at approximately the same height before and after it levers. Cable 15 in FIG. 1A moves roller 88 at the top of the automatic crossbar into contact with wheel 16 so that lever 81 is hinged to unlock the automatic crossbar. Roller 88 begins rolling under rail 200 between positions $P_1$, and $P_2$. It then rolls under the rail from position 200*a* to 200*e*. When roller 88 rolls off the end of rail system 200 at position 200*e*, and out from under wheel 17, the crossbar locks as follows: The expanding spring in the shock and the stored gravity swings the automatic crossbar down at a speed controlled by air compression and release from the shock. To lock, the swinging automatic crossbar impacts the rounded tip of bolting probe 65 (FIG. 1F) against the outside of break-away wall 38 (FIGS. 1C and 1CA). FIG. 1F shows that spring 72 will be flexed to permit the impact to force bolting probe 65 back into hole 66 (like slamming a door with an equivalent mechanism). Spring 72 then forces bolting probe 65 out to lock into slot 33 (FIG. 1C) and the rotation of the lock-box stops against stop-plate 54 (FIG. 1D). Square rubber piece 55 cushions the impact of the lock-box against stop-plate 54.

Users may load and unload in either direction, going uphill or downhill. Before reaching the terminal in FIG. 1A, elongated bar 20 on passenger chair 10 hangs crossbar 20*a* at its first closed position. Crossbar 20*a* allows room for a person's hand or arm to fit between crossbar 20*a* and arched bars 10*b* or 10*c* without being caught when the crossbar automatically closes. The automatic crossbar is held shut by lateral-extension and lock-box 60 above chair 10. The lock-box contains passengers in the chair during transport. Passengers cannot open the lock by pushing on the crossbar. The elongated bar runs down in front-center of the chair providing passengers with an increased sense of safety.

Position $P_2$ shows crossbar 20*a* in a second opened position. Roller 88 and the rest of the upper portion of the elongated bar rotates back as the roller impacts wheel 16 and rolls under rail system 200. Rail system 200 (including wheel 16) is the blocking structure that causes upper portion 20*v* of elongated bar 20 to rotate back upon impact. The elongated bar pivots at the axis of bolt 21*b*. The pivotal mount of the elongated bar to the passenger chair at a position substantially above the crossbar permits the crossbar and the lower portion of the elongated bar to swing forward away from the front of the passenger chair to a second opened position. The portion of the elongated bar below bolt 21*b* swings forward and upward. The crossbar on bottom may be grasped by a dismounting user as it moves to the opened position to assist them with standing. As the rail begins sloping downward gradually after position 200*b*, the crossbar swings further open forward and upward.

At opened position $P_2$, crossbar 20*a* hangs open several inches ahead of the front of the seat. By the time roller 88 runs under wheel 16, passengers should be grasping crossbar 20*a* to facilitate their dismount. Because the crossbar opens to a position above the passenger's knees, it encourages passengers to lean forward, balancing their center of mass over their feet when standing from the chair. Passengers should allow their skis to rest on the supporting snow surface below positions $P_1$, $P_2$, and $P_3$. Passengers will feel a solid connection when grasping the crossbar. Users may push or pull on the crossbar to maintain fore-aft balance. Pushing resistance is provided by the shock and pulling resistance is provided by the top of the elongated bar's contact with the rail. The lift is run at a slow speed. Chairs may be grouped closer together than normal because the lift is running slowly and fewer passengers are likely to fall on the exit ramp.

Dismounting passengers grasp the crossbar as they stand up on their skis (or snowboard). Users continue to hang onto the crossbar to avoid falling while they move forward along the exit platform. The user lets go and slide down the exit ramp as the crossbar rises rapidly from position $P_3$ to position $P_4$. As the crossbar swings up to overhead position $P_4$, skiers are encouraged to let go. Additionally, snowboarders with click-in bindings can use the extra balance provided by holding the crossbar to click their rear boot into its binding. Snowboarders without click-in bindings can set their rear boot on the back of the board while holding onto the crossbar.

After the crossbar is raised, the lift operator may clear falling snow off of the seat with a broom, and then a passenger may mount the chair. To mount, skiers move in front of a chair at the far side of the terminal under position 27*z*. They look back at the chair coming and put their arm around one of the arched bars (bars 10*b* or 10*c* on chair 10). The crossbar lowers after roller 88 passes under pipe 203*d* and rolls out from under wheel 17. Stored gravity and the spring in the shock causes the automatic crossbar to swing shut containing passengers. For safety, the speed of the closing crossbar is minimized by the upward sloping rail and by the compressed air escaping from the shock. The shock's air chambers also protect passengers from a dropping crossbar if the roller were to unexpected come out from under the rail at any time during passenger transport.

FIG. 1B shows elongated bar 20 attached from its upper hole (with bolt 21*b*), rather than at its lower hole (21*d*). FIG. 1C shows plate 30 with upper hole 32 and lower hole 31 for attaching the elongated bar. Accordingly, bolt 21*b* may be run through hole 21*d* in the elongated bar (FIG. 1B) and then into lower hole 31 (FIG. 1C) in plate 30. This causes the crossbar to move forward and upward to a lesser extent to be suitable for smaller users (such as children). Thus, children and adults can load onto chairs with facilitating crossbars that are more appropriate for the user's height. It is recommended that the automatic crossbars for smaller children be grouped in a line on the aerial cable and color coded to be distinguished from adult chairs. During a passenger evacuation (where the lift must be stopped), the automatic crossbar may be unlatched with the aid of a telescoping pole having a hooked end on top. To unlatch the crossbar, roller 88 is hooked with the telescoping pole from the rear side of the chair. It may be hooked by a sitting passenger, or by a ski patrol on the ground.

From the description and operation above, it is evident that the locking and facilitating crossbar will contain passengers during transport, and help passengers to stand without falling as they dismount. It has advantages for skiers, snowboarders, and other users. This automatic crossbar accomplishes the objectives set forth above.

From the description and operation above, it is evident that the locking and facilitating crossbar will contain passengers during transport, and help passengers to stand without falling as they dismount. It has advantages for skiers, snowboarders, and other users. This automatic crossbar accomplishes the objectives set forth above.

Description of FIGS. 2A to 2D:

The user-unlocking crossbar is designed with many of the same components as the preferred embodiment above. However, this crossbar may be opened by passengers during transport. The user-unlocking crossbar has a button-lock instead of a lock-box. The button-lock will stay closed when pushed against, but will open if impacted by a sudden and sufficient force, such as in an emergency.

Accordingly, the objects and advantages are the same as with the preferred embodiment above except that the following objects and advantages are added:

(q) to allow passengers to force open the crossbar.

Figure 2A:
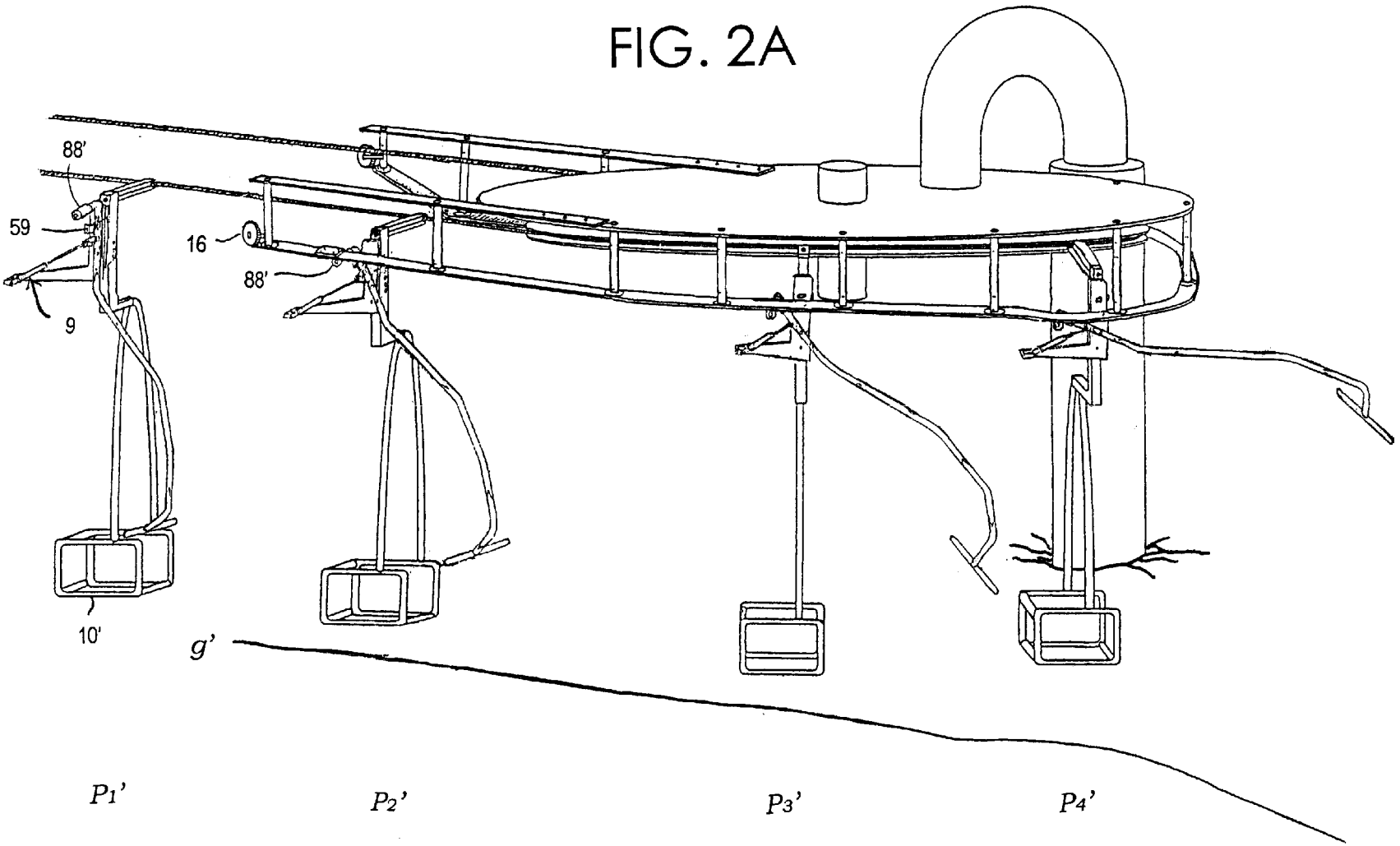
FIGS. 2A to 2D shows a user-unlocking crossbar and its components.

The user-unlocking crossbar shown in FIG. 2A is a method for facilitating passengers with their dismount onto landing platforms from chairs on aerial ski chair-lifts. The method provides a crossbar for gripping in front of passengers in its first closed position during transport. The method moves the crossbar forward away from the front of the chair to a second opened position during dismount. To contain passengers during transport, the method provides for a retaining and a locking of the crossbar in its first closed position across the front of the chair. It further provides a method for unlocking the crossbar prior to passenger dismount. This method of opening a crossbar on a ski chair-lift permits passengers to grasp the crossbar as it moves forward, facilitating their standing onto the slippery platform.

Figure 2B:
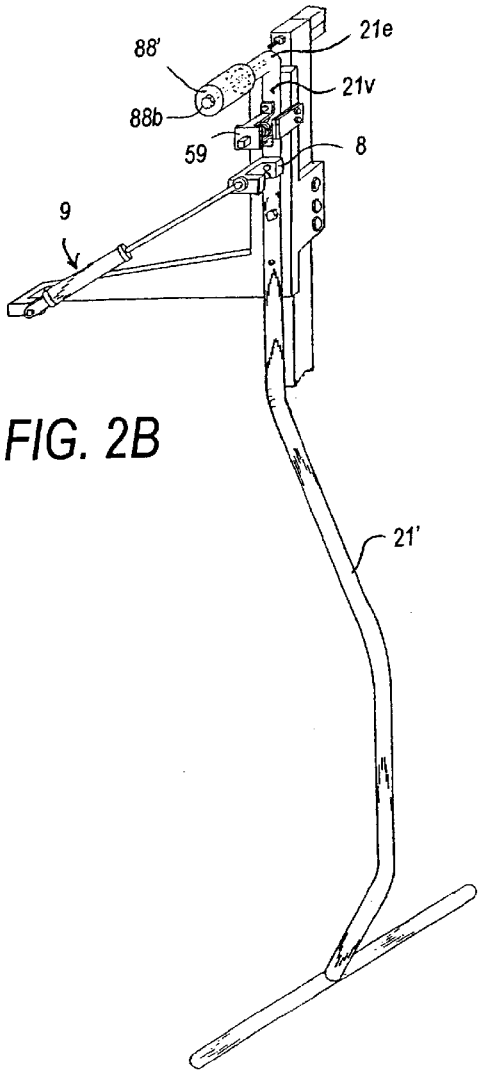

FIG. 2B shows that the user-unlocking crossbar includes many of the same components as the preferred automatic crossbar, including the pivotal mount, and the blocking structure (a rail system). It also includes several new components. FIG. 2B shows roller 88' attached by elongated bolt 88*b* to a threaded core in the solid top of lateral extension 21*e* of an elongated bar. Roller 88' is a sub-member of the upper portion of the elongated bar. Roller 88' is a friction reducing mechanism. Elongated bar 21' bends at a right angle from lateral extension 21*e* to upper portion 21*v* and continues downward. The elongated bar has a hole for button-lock mechanism 59 and two holes for bracket 8 attaching the shock (9), which is described later. Elongated bar 21' is substantially vertical in its first closed position in FIG. 2B. The elongated bar then continues downward in the same manner as in the preferred embodiment with the crossbar attached on bottom.

Figure 2C:
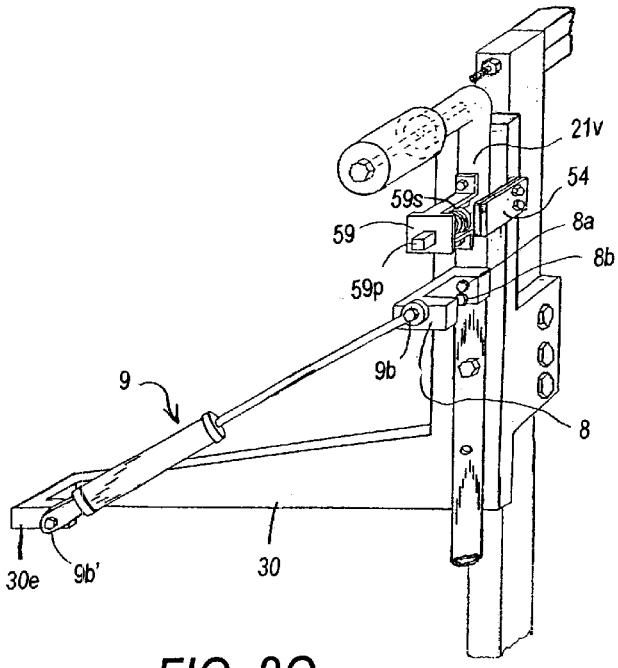
Figure 2D:
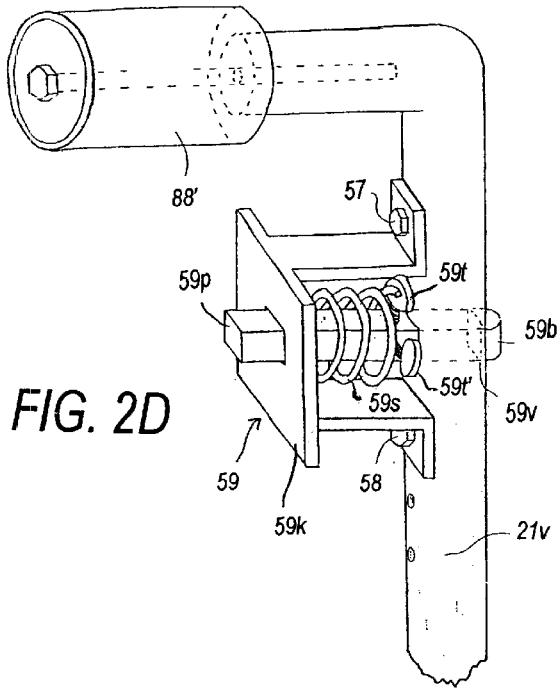

The unlocking crossbar in FIG. 2B has button-lock mechanism 59 instead of the lock-box. FIGS. 2B and 2C show button-lock 59 on elongated bar section 21*v*. FIG. 2D shows the components that make up button-lock 59 as follows: Extended bracket 59*k* is bolted to elongated bar section 21*v* by bolts 57 and 58. Rounded bolting probe 59*p* is run through bracket 59*k*, spring 59*s*, and hole 59*v* in the elongated bar portion 21*v*. The elongated bar is solid where hole 59*v* is cut in section 21*v*. Thumb screws 59*t* and 59*t'* are fastened into two threaded holes in probe 59*p*. The probe's rounded off button-like end 59*b* protrudes out of the back of elongated bar 21*v*. In FIG. 2C, the button-like end (not shown) of probe 59*p* enters a hole in plate 30' (not shown, but like hole 33' in FIG. 5B). The button-lock is a closure attachment for retaining the crossbar in a closed position across the front of the chair. It attaches the elongated bar to the passenger chair. This contains passengers in the chair during transport. The button-lock includes an automatic locking mechanism, and a lock releasing mechanism (for releasing the lock when the top of the automatic crossbar device impacts the blocking rail structure).

FIG. 2C shows that bolt 9*b'* attaches shock 9 to extrusion 30*e* on plate 30'. The other side of the shock is attached by bolt 9*b* into a threaded hole (not shown) in "C" shaped bracket 8. Bracket 8 is attached with bolts 8*a* and 8*b*, which are screwed into threaded holes (not shown) in elongated bar section 21*v*. Shock 9 is the same as described in the preferred embodiment.

The user-unlocking crossbar is used on passenger chairs of aerial chair-lifts. This new and improved automatic crossbar operates much like the preferred automatic crossbar. It contains users and assists them with their dismount onto the landing platform. Chair 10' in FIG. 2A shows the crossbar and the elongated bar in their first closed position ($P_1$'). The crossbar is suspended across the front of the passengers to contain them. FIG. 2A shows that the mount of the elongated bar permits the crossbar and the elongated bar to swing forward away from the front of the passenger chair to a second opened position in positions $P_2$', $P_3$', and $P_4$'. Like the preferred embodiment, the rail system causes the upper portion of the elongated bar to rotate back upon impact with its sub-member, roller 88'. Then the roller runs under the rail, thereby levering forward the crossbar below the pivotal mount to a second opened position. During this levering, the crossbar may be grasped by a dismounting user to assist them with standing. Roller 88' is a friction reducing mechanism for reducing wear on the upper portion of the elongated bar when it impacts the blocking structure.

In FIG. 2A, button-lock 59 opens when roller 88' impacts wheel 16. FIGS. 2B and 2C provide an enlarged view of these components. FIG. 2D shows that the probe's button-like tip (59*b*) may be forced back through hole 59*v* after impact, allowing the crossbar to open. Spring 59*s* holds the probe in the hole and allows the lock to release when the probe is forced back. To lock the crossbar when the chair leaves the terminal, the automatic crossbar swings shut like a closed door (FIG. 2B). The end of probe 59*p* in FIG. 2D is forced back into its hole (not shown) in plate 30' when it impacts the wall of plate 30'. Then spring 59*s* pulses probe button 59*b* back out until it locks into its hole in plate 30'. In FIG. 2C, upper portion 21*v* of the elongated bar comes to rest against stop-plate 54. The automatic crossbar is then held closed by the locking of probe 59*p*, and separately with tension from shock 9.

It is operated much like the preferred automatic crossbar above. The button-lock dissuades passengers from trying to open the crossbar. However, users may unlock the automatic crossbar by thrusting their palms hard against the bar, and then holding the crossbar open. Alternatively, a ski patrol can hook the crossbar from the ground and yank on the crossbar to open it.

From the description and operation above, it is evident that the user-unlocking crossbar will contain passengers during transport, and help passengers avoid falling when dismounting. It has advantages for skiers, snowboarders, and other users. It accomplishes the objectives set forth above.

Figure 3A:
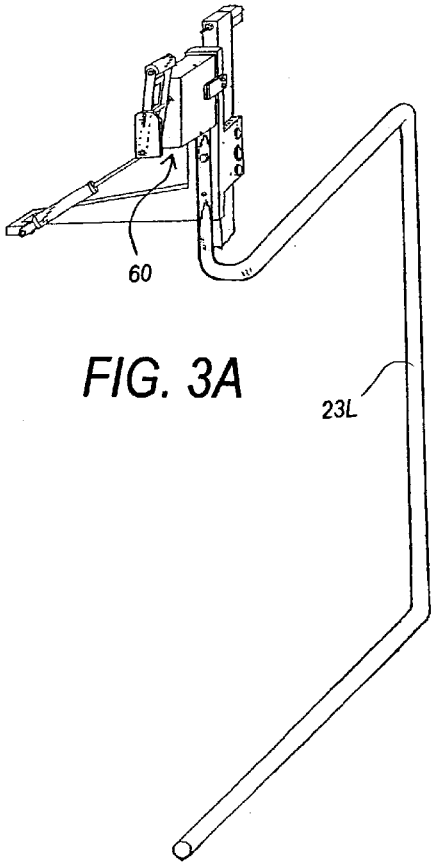
FIG. 3A shows an alternative automatic crossbar that suspends its crossbar from the side.

Description of FIG. 3A:

This automatic crossbar suspends the crossbar from the chair's side, rather than from its center.

Accordingly, the following objects and advantages are added to those listed in the preferred embodiment:

(r) to provide passengers with a better view during transport.

The automatic crossbar shown in FIG. 3A includes an elongated bar that runs down from lock-box 60, then forward, then out to the side, and then downward with vertical bar 23L before attaching to the side of a horizontal crossbar. Except for the alterations in the shape of the elongated bar, it includes the same components and mechanisms as in the preferred embodiment.

This device is used in the same manner as the preferred automatic crossbar. Its common components function the same.

From the description and operation above, it is evident that suspension of the crossbar from its side provides passengers with a better view.

Figure 4A:
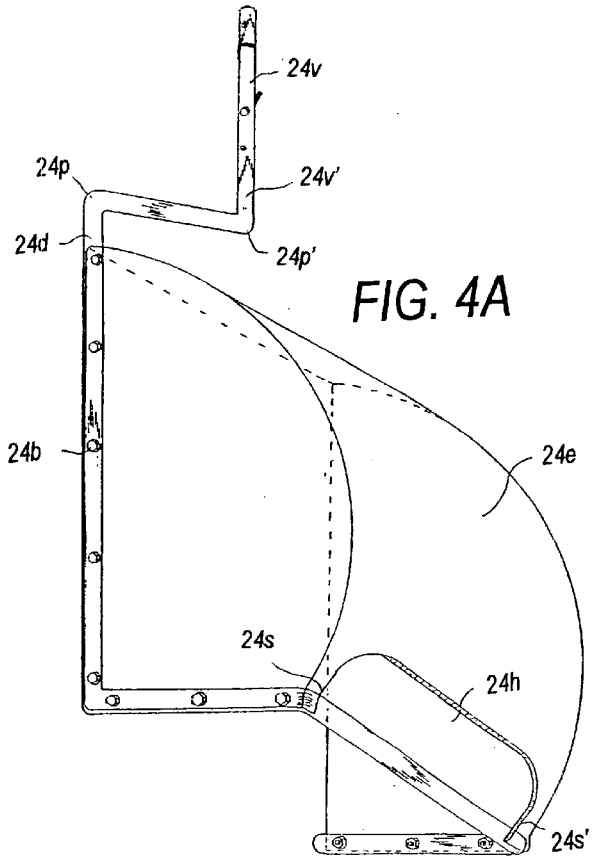
FIG. 4A shows an elongated bar having a weather shield enclosure.

Description of FIG. 4A:

The elongated bar in FIG. 4A includes a transparent enclosure.

Accordingly, the following objects and advantages are added to those listed in the preferred embodiment:

(s) to provide passengers with protection from bad weather.

The crossbar with weather shield is substituted for the elongated bar in the preferred embodiment. Except for the elongated bar, it has all the same components and mechanisms. FIG. 4A shows an elongated bar that run down from its upper portion 24*v* to bend at position 24*p',* then out to bend at position 24*p,* then down past position 24*d,* then forward, then across (as a crossbar), and then back. The inside angle of bends 24*p'* and 24*p* are slightly more than 90°. Enclosure 24*e* is made of a transparent high strength impact-resistant material. It is bolted to bars where the bars contact the side and bottom of the enclosure. Numerous nuts and bolts, including with bolt 24*b,* are used. The enclosure is used with a lock-box on top (see FIG. 1B), to prevent wind from opening it. It is recommended that bar 11*v* (FIG. 1J) suspending the chair from the aerial cable and lower section 24*v'* of the elongated bar be lengthened a couple feet. This lengthening allows enclosure 24*e* more space to open further overhead without interfering with any structures above it. Alternatively, the present dimensions will function well if the enclosure is opened only partially and the slope of the exit ramp is increased. For safety, hole 24*h* is several inches above the crossbar (bigger than an adults fist, but smaller than a child's head). Additionally, the outer edge of the hole from 24*s* to 24*s'* is rounded smooth to prevent it from catching on a passengers arm or hand.

This automatic crossbar is used and functions in the same manner as with the preferred automatic crossbar. Its common components function the same.

From the description and operation above, it is evident that this automatic enclosure has advantages for users in severe weather.

Figure 5A:
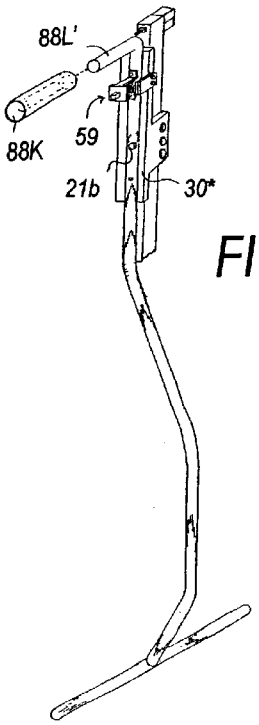
FIGS. 5A to 5B shows a simplified automatic crossbar that locks.
Figure 5B:
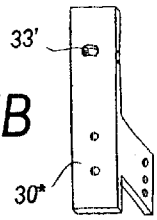

Description of FIG. 5B:

This simplified automatic crossbar has the necessary elements to facilitate a passenger with dismounting, and to provide a temporarily locking containment of passengers.

Accordingly, the following objects and advantages are added to those listed in the FIG. 2B embodiment:

(t) to provide a low cost automatic locking bar that helps passengers dismount a chair-lift;

(u) to provide an automatic bar that can be pushed out of the way by experienced passengers.

The unlocking gravity bar in FIG. 5A is constructed like the automatic crossbar in FIG. 2B, except that there is no roller on the lateral extension at the top, and no components related to the compression shock. With no shock, the arm-like plate in FIG. 2C has been cut to be simple plate 30" in FIG. 5B. Hole 33' on plate 30" will receive the probe button. In FIG. 5A, lateral extension 88L' has been lengthened to extend as far as the length of the former roller. Extension 88L' is a sub-member of the upper portion of the elongated bar. A replaceable plastic casing, 88*k* , may be added to further reduce friction, and to minimize wear on the sub-member. Except for these differences, it has all the same components and mechanisms as described in FIG. 2B.

This automatic crossbar is used and functions in much the same manner as with the automatic crossbar in FIG. 2B. Its common components function in the same manner. Lateral extension 88L' acts as a sub-member of the upper portion of the elongated bar. It operates much like earlier rollers in the way it runs under the blocking wheel and rail system. The bar opens with similar mechanics to the automatic crossbar in FIG. 2A. Users can hold onto the crossbar to help them stand as they dismount. The automatic crossbar closes with the aid of stored gravity after coming out from under a blocking rail system. The elongated bar snaps shut with button-lock 59. The tightness of bolt 21*b* and its brake-pad washer permits a slowed, low-friction, closing of the automatic crossbar. The tightness of bolt 21*b* may be adjusted to control the amount of friction from the brake-pad washer.

From the description and operation above, it is evident the unlocking automatic crossbar is functional without a shock.

Figure 6A:
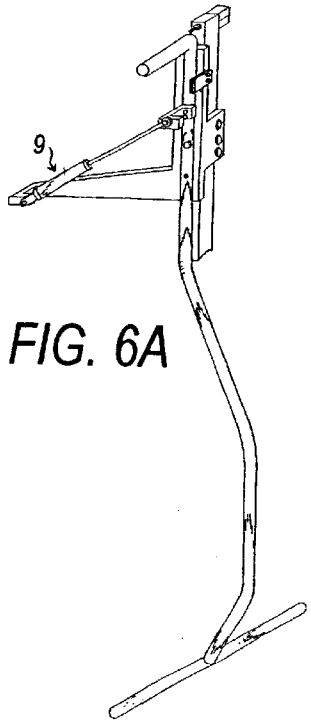
FIG. 6A shows a simplified automatic crossbar that closes with an expanding shock.

Description of FIG. 6A:

This simplified automatic crossbar has all the necessary elements to facilitate a passenger with dismounting and provide containment during transport.

Accordingly, the following objects and advantages are added to those of the embodiment in FIG. 2B:

(v) to provide a low cost automatic closing crossbar for dismounting passengers on chair-lifts.

Accordingly, the following objects and advantages related to locking are removed:

(d) to provide an automatic crossbar that locks closed;

(e) to allow it to be unlocked by someone from the ground during an emergency;

(f) to provide a fail-safe brake-away system to force the lock open if it fails, so as to not damage the lock or endanger passengers.

The alternative closing crossbar in FIG. 6A is constructed much like the automatic crossbar in FIG. 5A, except that the components related to the compression shock have been substituted for the button-lock. Except for these differences, it has all the same components and mechanisms as described earlier.

The closing crossbar is used in much the same manner as the preferred automatic crossbar in FIG. 1A. Its common components function in the same manner. Users can hold onto the crossbar to help themselves stand as they dismount. The closing crossbar closes with the aid of stored gravity and the expansion of shock 9 after it is compressed. The spring in the shock holds the crossbar closed.

From the description and operation above, it is evident the closing crossbar with shock is a functional automatic crossbar that contains passengers without a locking mechanism.

Figure 6B:
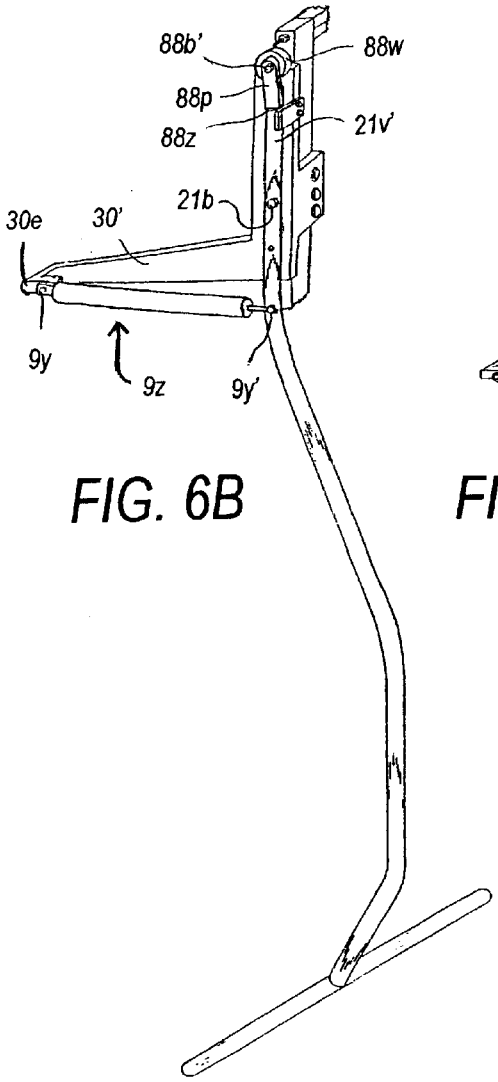
FIG. 6B shows a simplified automatic crossbar that closes with a retracting hydraulic closer.

Description of FIG. 6B:

This automatic crossbar has a hydraulic closer to contain passengers during transport, and all the necessary elements to facilitate passengers with dismounting.

Accordingly, the following objects and advantages are added to those of the embodiment in FIG. 6B:

(w) to provide a low cost automatic crossbar with an elastic attachment mechanism for closing that is available from existing door-closer technology.

The hydraulic closing crossbar is constructed much like the embodiment shown in FIG. 6A. However, it includes hydraulic closer 9*z* instead of a compression shock, and wheel 88*w* instead a lateral extension. Wheel 88*w* is a sub-member of the upper portion of the elongated bar. The specified hydraulic door closer (9*z*) is an elastic retraction device manufactured by National Manufacturing Company, Sterling Ill. 61081. It has the item number N189-704 V1342. Hydraulic closer 9*z* is attached to a threaded hole in extension 30*e* of arm-like plate 30' by bolt 9*y*, and to a threaded hole in the elongated bar with bolt 9*y'*. Wheel 88*w* is attached to the top of elongated bar 21*v'* with a short plate 88*p* that is welded at position 88*z* to the front. The wheel is then attached to the elongated bar by bolt 88*b'*, and a washer and nut (not shown). The hydraulic closer is a closure attachment for retaining the crossbar in a closed position by attaching the elongated bar to the passenger chair. The hydraulic closer also falls within the categories of an elastic attachment mechanism, and a spring attachment mechanism.

The hydraulic closing crossbar opens with equivalent mechanics as the automatic crossbar in FIG. 6A. Wheel 88*w* levers the elongated bar as a sub-member of its upper portion. Hydraulic closer 9*z* retracts after a lengthening force is removed. It also includes a hydraulic system to slow its retraction, and to minimize bouncing. Hydraulic closer 9*z* is attached below the pivot-point at bolt 21*b* on the elongated bar. Thus, to shut, closer 9*z* pulls on the bottom of the elongated bar, rather than pushing on the top of the elongated bar like the shock. Users can hold onto the crossbar to help them stand up as they dismount. The hydraulic closing crossbar shuts with the aid of retraction from closer 9*z* and stored gravity, after passing the lengthening force of the blocking structure.

From the description and operation above, it is evident that the hydraulic closing crossbar will retain passengers with a retracting closer, rather than using a compression shock.

Figure 6C:
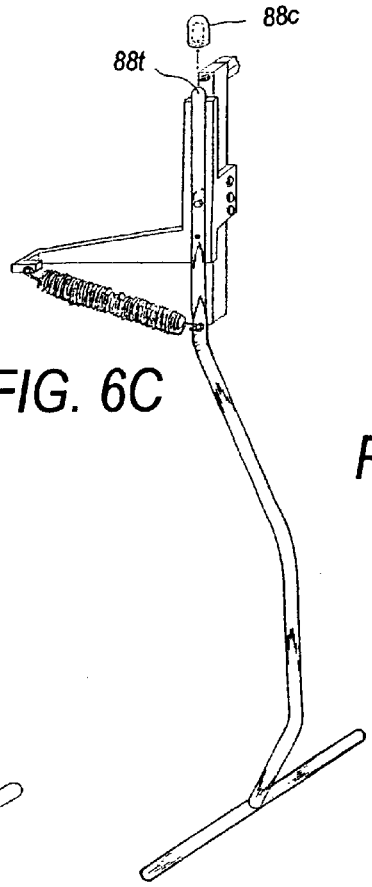
FIG. 6C shows a simplified automatic crossbar having a spring to contain passengers.

Description of FIG. 6C:

This simplified automatic crossbar has all the necessary elements to facilitate passengers with dismounting, and to contain them during transport.

Accordingly, the following objects and advantages are added to those of the embodiment in FIG. 6A:

(x) to provide a very low cost elastic closing mechanism.

The spring closing crossbar is shaped much like the automatic crossbar in FIG. 6A, except that it has no lateral extension on top, and no compression shock. The rounded elongated bar tip 88*t* at top of the elongated bar section of the automatic crossbar is rounded off to lessen friction. This reduces wear on the upper portion of the elongated bar when it impacts the blocking structure. A replaceable plastic cap 88*c* may be glued onto the pole tip at the top of the elongated bar to further reduce friction. This underside of the rail blocking system can be greased to further reduce friction. The spring is a closure attachment for retaining the crossbar in a closed position by attaching the elongated bar of the automatic crossbar to the passenger chair. The spring also falls within the categories of an elastic attachment mechanism, a spring attachment mechanism, and an elastic retraction device.

The spring closing crossbar opens with equivalent mechanics as the automatic crossbar in FIG. 6B. Pole tip 88*t*, at the top of the upper portion of the elongated bar, runs under the wheels and slides on the underside of rail system 200 in FIG. 1L. The bar opens with similar mechanics as the preferred automatic crossbar in FIG. 1A. Users can hold onto the crossbar to help them stand up as they dismount. The closing crossbar shuts with the aid of stored gravity, and contains passengers with the tension of the spring.

From the description and operation above, it is evident that a spring can be used as a closure attachment to retain passengers using an automatic crossbar.

Figure 6D:
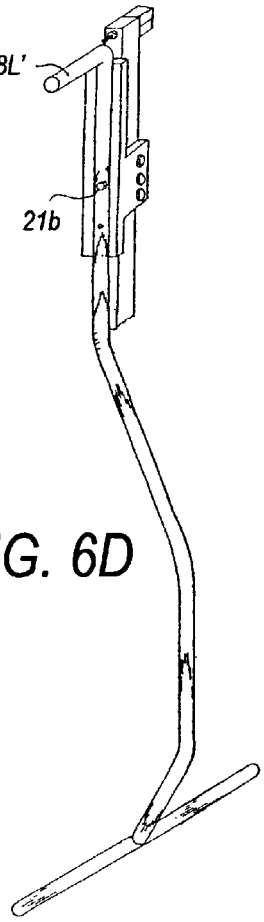
FIGS. 6D & 6E shows a simplified automatic crossbar and a simplified blocking structure.
Figure 6E:
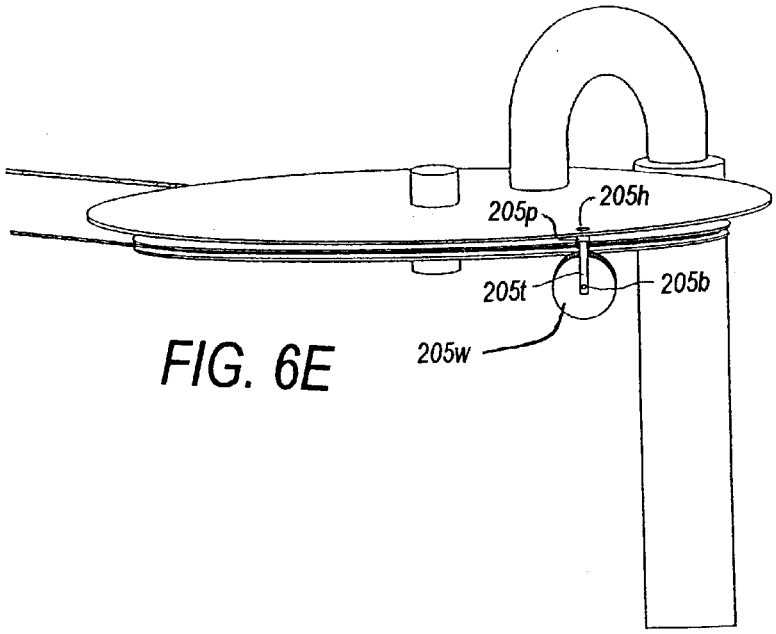

Description of FIGS. 6D and 6E:

The simplified automatic crossbar has all the necessary elements to facilitate passengers with dismounting.

The main objective of this automatic crossbar is to facilitate passengers with their dismount. The objective to lock in passengers is inapplicable in the simplified dismounting bar embodiment. Accordingly, the following objects and advantages related to locking are removed from the preferred embodiment in FIG. 1B:

(d) to provide an automatic crossbar that locks closed;

(e) to allow it to be unlocked by someone from the ground during an emergency;

(f) to provide a fail-safe brake-away system to force the lock open if it fails, so as to not damage the lock or endanger passengers;

Accordingly, the following objects and advantages are added:

(aa) to provide a low cost automatic bar for dismounting a near-surface chair-lift;

(bb) to provide a low cost blocking structure;

(cc) to permit experienced passengers to push the crossbar out of the way.

The simplified dismounting bar version of the automatic crossbar is a method for facilitating passengers with their dismount onto a landing platform from chairs on aerial ski chair-lifts. The method provides a crossbar for gripping in front of passengers in its first closed position during transport. The method moves the crossbar forward away from the front of the chair to a second opened position during dismount. This method of opening a crossbar on a ski chair-lift permits passengers to grasp the crossbar as it moves forward, facilitating their standing onto the slippery platform.

The simplified dismounting bar includes all the necessary components to assist users with dismounting. It includes a pivotal mount, an elongated bar (with an upper portion above the pivotal mount), and a crossbar. The elongated bar is substantially vertical in its first closed position. The crossbar is attached to the bottom of the elongated bar, so that the crossbar is suspended across the front of the passenger chair with the crossbar and the elongated bar in their first closed position. The pivotal mount attaches the elongated bar to a passenger chair at a position substantially above the crossbar. This permits the crossbar and the elongated bar to swing forward away from the front of the passenger chair to a second opened position. The blocking structure in FIG. 6E (wheel 205*w*) is disposed above the landing platform in the path of the upper portion of the elongated bar as the passenger chair moves forward. Lateral extension 88L' is a sub-member of the upper portion of the elongated bar. The blocking structure causes the upper portion of the elongated bar to rotate back upon impact, thereby levering forward the crossbar below the pivotal mount to a second opened position. Then the crossbar may be grasped by a dismounting user to assist them with standing. It is constructed with fewer components than the preferred crossbar. The dismounting bar in FIG. 6D is like the automatic crossbar in FIG. 5A, except that it has no button-lock on the top of the elongated bar. The underside of the rail can be greased to reduce friction on lateral extension 88L'.

Many blocking structures will function to open the automatic crossbar. The blocking structure may take on many shapes, as long as it lines up with the upper portion of the elongated bar. The suspended blocking wheel in FIG. 6E is an example of a simpler structure that will open the automatic crossbar. The suspended wheel in FIG. 6E is comprised as follows: Short pipe 205*p* is screwed up into threaded hole 205*h* and then welded on top. Then plate 205*t* is welded to the front of pipe 205*p*. A hole is drilled through the bottom of plate 205*t* so that blocking wheel 205*w* can be attached by bolt 205*b*, along with a washer and a locking nut on back (not shown). Alternatively, the simplified dismounting bar may be used with the full rail system in FIG. 1L.

The simplified dismounting bar is used on passenger chairs of aerial chair-lifts. This new and improved automatic crossbar operates much like the preferred automatic crossbar in assisting users with their dismount onto the landing platform. The crossbar opens as lateral extension 88L', at the top of the upper portion of the elongated bar in FIG. 6D, impacts blocking wheel 205*w* in FIG. 6E. It opens with similar mechanics as the preferred automatic crossbar in FIG. 1A. Users can hold onto the crossbar to help them stand up as they dismount. The dismounting crossbar closes with the aid of stored gravity. The tightness of bolt 21*b* and its brake-pad washer permits a slowed low friction closing of the automatic crossbar. The tightness of bolt 21*b* may be adjusted to control the amount of friction from the brake-pad washer. Wheel 205*w* in FIG. 6E may open the automatic crossbar quickly if the lift is running at a high speed, so running the lift at a low speed is recommended. Alternatively, the full rail system in FIG. 1L may be used for blocking at higher speeds.

From the description and operation above, it is evident that the simplified dismounting bar (without a lock) assists users with safely dismounting the chair-lift. The simplified dismounting bar is recommended when there is little risk of injury from falling out of the chair during transport, such as on near-surface ski chair-lifts. Additionally, because adults are not as likely as children to fall out of chair-lifts, it may be used for adults that are comfortable riding on higher chair-lifts.

Conclusion, Ramifications, and Scope

Accordingly, the reader will understand that my automatic crossbar invention in its several embodiments will protect passengers during transport, and assist them with dismounting. Skiers, snowboarders, and other sliding (or rolling) sport enthusiasts, and even foot passengers may grasp the crossbar to help them stand onto the landing platform. It may be used in a variety of winter weather conditions, and in the summertime by foot passengers and in-line skaters.

Although the description above contain many specificities, these should not be construed as limiting the scope of the invention but merely providing illustrations of some of the presently preferred embodiments of this invention. Some of the many alternative variations are listed below. For example, customized alterations may be made in the rail system to allow the crossbar to open at predetermined locations, and with desired intensities to suit various users and fit chair-lift designs. A pause of the crossbar at a height between the user's waist and chest is preferred. Alternatively, the rail system may be built to move the crossbar quickly to an overhead position on chair-lifts. The rail system can be altered and customized by bending or cutting the rail and exchanging pipes of the appropriate length. Adjustments to the opening intensity of the crossbar may be needed for lifts that operate at one speed, and for lifts with experienced passengers that do not wish to use the automatic crossbar to facilitate their dismount. Additionally, planks 18 and 19 in FIG. 1L can be thickened and extended to allow more time for mounting, and dismounting. Long square pipes of a substantial width can be substituted for extended planks to increase structural integrity.

Alternative blocking structures

Additionally, for unloading at a mid-station along the length of the chair-lift, the suspended rail system may be attached to towers rather than to the terminal. A rail system that is suspended from a tower would run parallel with the cable. An experienced welder can suspend the rail system or an alternative blocking structure. Numerous alternative blocking structures may be substituted for the rail system, or the blocking wheel shown above. Many shapes of blocking structures would work to open the crossbar, even a pipe arranged in the path of the upper portion of the elongated bar.

Alternative attachment of plate 30

It is recommended that plate 30 (FIG. 1C) be attached in a vertical manner, so that the crossbar and elongated bar swing directly forward. FIG. 1J allows for a direct attachment to the outside of the vertical chair suspension bar (11*v*). However, if the suspension bar at the top of the chair is not vertical (such as in FIG. 1K), then mounting plate 30 may be attached by extension plate 30*x* to position plate 30 vertical. Various chair-lift designs would require other custom extension plates.

Alternative locking mechanisms

Additionally, the automatic locking mechanism can take on many forms other than the probe and hole locks shown above. It may be a magnetic lock, a hooking lock, or any of the multitude of automatic locks that exist on doors. It may be designed to open by a sudden impact that forces the lock open, or to release by activating a lever, button, pad, or equivalent mechanism.

Alternatives related to closers

Hydraulic closer 9*z* in FIG. 6B may be substituted for the compression shock on any of the embodiments of the invention. Alternatively, many types of door closers may be used. The tension of the closer may be increased for adults, and reduced for children. Many standard door closers allow for adjustments in tension.

Alternative elongated bars

The preferred elongated bar in FIG. 1A can be replaced by any shape of bar that suspends the crossbar in front of seated passengers. Modification in the shapes of the automatic crossbars can be made to accomplish the objectives of the automatic crossbar, and fit various designs of chairs.

Alternative rolling mechanisms

Roller 88 in the preferred embodiment may be replaced by any low friction mechanism, including ball and socket systems, other types of rollers, readily available wheels, or other equivalent low friction mechanisms.

Cueing of chairs on chair-lifts with detachable chairs

Detachable chair-lifts (now common at many ski resorts) automatically cue up chairs under the bull-wheel prior to loading passengers. Interference between opened crossbars and the chairs ahead can be avoided in several ways. As long as the length of the crossbars fit between the arched bars in the chair ahead, interference can be avoided. The arched bars can be widened if necessary for cueing. Alternatively, the automatic crossbars can be closed during cuing by raising the rail height above the section where chairs are cued. Then the rail can be made to slope downward to open the automatic crossbar for loading.

As shown above, it is evident that many components can be altered, deleted or substituted with an equivalent component. Thus the scope of the invention should be determined by the appended claims and their legal equivalents, rather than by the examples given.

I claim:

1. A new and improved automatic crossbar for use on passenger chairs of aerial chair-lifts for facilitating dismounting of passengers onto a landing platform comprising of:

(a) at least one elongated bar, (b) said elongated bar being substantially vertical in its first closed position, (c) said elongated bar having a top and a bottom, (d) a crossbar, (e) wherein said crossbar is attached proximal to the bottom of said elongated bar, (f) a first means for pivotably mounting said elongated bar to a passenger chair, at a position substantially above said crossbar, (g) whereby said crossbar is suspended across the front of the passenger chair with said crossbar and said elongated bar in their first closed position, (h) whereby said first means for pivotably mounting said elongated bar permits said crossbar and said elongated bar to swing forward away from the front of said passenger chair to a second opened position, (i) said elongated bar having an upper portion extending above said first means for pivotably mounting, (j) a blocking structure disposed in the path of the upper portion of said elongated bar as said passenger chair moves forward to the landing platform, (k) whereby said blocking structure causes said upper portion of said elongated bar to rotate back upon impact, thereby levering forward said crossbar below pivotal mount to a second opened position, whereby said crossbar is configured to swing in a manner to pull passengers forward to a standing position, with the passenger grasping the cross bar.

2. The automatic crossbar of claim 1 further including a second means for retaining said crossbar in its first closed position across the front of said chair, wherein said second means attaches said elongated bar to said chair, whereby passengers are contained in the chair during transport.

3. The automatic crossbar of claim 2 wherein said second means for retaining said crossbar is an elastic attachment mechanism.

4. The automatic crossbar of claim 3 wherein said second means to retain said crossbar is a spring attachment mechanism.

5. The automatic crossbar of claim 4 further including a third friction reducing means for reducing wear on the upper portion of said elongated bar when it impacts said blocking structure.

6. The automatic crossbar of claim 3 wherein said second means for retaining said crossbar is an elastic expansion device.

7. The automatic crossbar of claim 6 further including a third friction reducing means for reducing wear of the upper portion of said elongated bar when it impacts said blocking structure.

8. The automatic crossbar of claim 3 wherein said second means for retaining said crossbar is an elastic retraction device.

9. The automatic crossbar of claim 8 further including a third friction reducing means for reducing wear of the upper portion of said elongated bar when impacting said blocking structure.

10. The automatic crossbar of claim 2 wherein said second means for retaining said crossbar further includes an automatic locking mechanism.

11. The automatic crossbar of claim 10 wherein said second means for retaining said crossbar further includes a lock releasing assembly for releasing said automatic locking mechanism upon impact of the upper portion of said elongated bar with said blocking structure.

12. The automatic crossbar of claim 10 further including a third friction reducing means for reducing wear of the upper portion of said elongated bar when it impacts said blocking structure.

13. A new and improved automatic crossbar for use on passenger chairs of aerial chair-lifts for facilitating dismounting of passengers onto a landing platform comprising of:

(a) at least one elongated bar, (b) said elongated bar being substantially vertical in its first closed position, (c) said elongated bar having a top and a bottom, (d) a crossbar (e) said crossbar being attached proximal to the bottom of said elongated bar, (f) a pivotal mount attaching said elongated bar to a passenger chair at a position substantially above said crossbar, (g) whereby said crossbar is positioned across the front of said passenger chair when said elongated bar and said crossbar are in their first closed position, (h) whereby said pivotal mount permits said crossbar and said elongated bar to swing forward away from the front of said passenger chair to a second opened position, (i) wherein said elongated bar has an upper portion extending above said pivotal mount, (j) a blocking structure disposed in the path of the upper portion of said elongated bar while said passenger chair moves forward to the landing platform, (k) whereby said blocking structure causes said upper portion of said elongated bar to rotate back upon impact, thereby levering forward said crossbar below said pivotal mount to a second opened position, whereby said crossbar is configured to swing in a manner to pull passengers forward to a standing position, with the passenger grasping the cross bar.

14. The automatic crossbar of claim 13 further including a closure attachment between said elongated bar and said passenger chair for retaining said crossbar in its first closed position across the front of said chair, whereby passengers are contained during transport.

15. The automatic crossbar of claim 13 further including an automatic locking mechanism between said elongated bar and said passenger chair for retaining said crossbar in its first closed position across the front of said chair, whereby passengers are contained during transport.

16. The automatic crossbar of claim 13 further including an elastic attachment mechanism between said elongated bar and said passenger chair for retaining said crossbar in its first closed position across the front of said chair, whereby passengers are contained during transport.

17. A method for operating an aerial ski chair-lift, comprising the steps of:

(a) providing at least an aerial ski chair-lift, which includes a suspended chair provided with a crossbar assembly, which includes a crossbar arranged to move between a first opened position away and substantially forward of the chair and a closed position at the chair for retaining at least a passenger on the chair;

(b) having at least a passenger sitting on the chair for transport and positioning the crossbar in the closed position;

(c) transporting the passenger to a skier landing platform; and (d) applying a force to move the crossbar substantially in a forward direction while having the passenger grasp the crossbar to pull and assist the passenger with standing up, by the moving force, at the skier landing platform.

18. The method of claim 17, further comprising the step of retaining said crossbar in the closed position across the front of the chair during a passenger transport, thereby containing the passenger.

19. The method of claim 17, further comprising the step of locking said crossbar in the closed position during a passenger transport.

20. The method of claim 19, further comprising the step of unlocking the crossbar prior to a passenger dismount.

* * * * *